United States Patent [19]

Terauchi

[11] Patent Number: 4,548,556

[45] Date of Patent: Oct. 22, 1985

[54] INTERFITTING MECHANISM OF SPIRAL ELEMENTS FOR SCROLL-TYPE FLUID DISPLACEMENT APPARATUS

[75] Inventor: Kiyoshi Terauchi, Isesaki, Japan

[73] Assignee: Sanden Corporation, Japan

[21] Appl. No.: 617,184

[22] Filed: Jun. 4, 1984

[30] Foreign Application Priority Data

Jun. 3, 1983 [JP] Japan ..... 58-99926

[51] Int. Cl.[4] ..... F01C 1/04; B23P 15/00

[52] U.S. Cl. ..... 418/55; 418/57; 418/107; 29/156.4 R; 29/434

[58] Field of Search ..... 418/55, 57, 107–109; 29/156.4 R, 434, 464

[56] References Cited

U.S. PATENT DOCUMENTS 3,386,648 6/1968 Van Rossem ..... 418/108
3,924,977 12/1975 McCullough ..... 418/57

FOREIGN PATENT DOCUMENTS 217021 5/1958 Australia ..... 418/108
57-193793 11/1982 Japan ..... 29/156.4 R

*Primary Examiner*—John J. Vrablik
*Attorney, Agent, or Firm*—Banner, Birch, McKie & Beckett

[57] ABSTRACT

A scroll-type fluid displacement apparatus and a method of assembling the apparatus wherein an adjustment member provides proper alignment of parts. The apparatus includes a front end plate and a casing through which a hole extends, a bore formed in the end plate of an orbiting scroll, and a hole formed in a fixed scroll. The front end plate is fixed on the casing and the adjustment member is inserted through the hole and extends into the hole of the fixed scroll and the bore of the orbiting scroll. Then, the front end plate is rotated toward the driving direction until further movement is prevented. The front end plate is then tightly secured on the casing, thus adjusting the angular relationship between both scrolls.

5 Claims, 8 Drawing Figures

INTERFITTING MECHANISM OF SPIRAL ELEMENTS FOR SCROLL-TYPE FLUID DISPLACEMENT APPARATUS

BACKGROUND OF THE INVENTION

This invention relates to a fluid displacement apparatus, and more particularly, to an adjusting mechanism of the angular relationship between spiral elements for a scroll-type fluid displacement apparatus.

Scroll-type fluid displacement apparatus are well known in the prior art. For example, U.S. Pat. No. 801,182 (Creux) discloses a device including two scroll members each having a circular end plate and a spiroidal or involute spiral element. These scroll members are maintained angularly and radially offset so that both spiral elements interfit to form a plurality of line contacts between their spiral curved surfaces to thereby seal off and define at least one pair of fluid pockets. The relative orbital motion of the two scroll members shifts the line contacts along the spiral curved surfaces and, therefore, the fluid pockets change in volume. Since the volume of the fluid pockets increases or decreases dependent on the direction of the orbiting motion, the scroll-type fluid displacement apparatus is applicable to compress, expand or pump fluids.

In comparison with conventional compressors of the piston type, the scroll-type compressor has certain advantages, such as fewer parts and continuous compression of fluid. However, in scroll-type compressors, adjusting the angular relationship between the spiral elements is difficult. If the angular relationship between the spiral elements is in error, the radial sealing points between the two spiral elements are not fully sealed, thus allowing fluid leakage. As a result of the fluid leakage, the efficiency of the compressor is reduced. One solution to the above problem is to reduce the dimensional tolerances of parts. However, manufacturing of the parts is complicated and expensive. Another solution is to limit the offset to maintain the desired angular relationship between the spiral elements. However, since there are many factors other than the offset which may cause the unsuitable angular relationship, this is not a complete solution.

During the assembly of a scroll-type compressor having a ball coupling mechanism, relative angular offset between both scroll members may occur as a result of the following factors;

(1) the relative angular offset between the fixed scroll element and housing;

(2) the relative angular offset between the housing and the front end plate;

(3) the relative angular offset between the front end plate and the fixed ring of the ball coupling mechanism;

(4) the relative angular offset caused by the difference between the inner diameter of the hole formed in the fixed ring of the ball coupling mechanism and the outer diameter of the ball;

(5) the relative angular offset caused by the difference between the outer diameter of the ball and the inner diameter of the hole formed in the movable ring of the ball coupling mechanism; and (6) the relative angular offset between the movable ring of the ball coupling mechanism and the orbiting scroll member.

In order to compensate for these factors, one technique is to adjust the angular relationship between a first hole formed on the end wall surface of the spiral element of one scroll member and a second hole formed through the front end plate opposite the first hole of the scroll member. Adjusting the angular relationship between both scroll elements is generally accomplished by an angle adjusting member inserted in both holes from outside of the front end plate. However, this technique can compensate only for the relative angular offset in factors (1)–(3) above. The relative angular offset caused by factors (4)–(6) cannot be eliminated using this technique.

SUMMARY OF THE INVENTION

It is a primary object of this invention to provide an efficient scroll-type fluid displacement apparatus.

It is another object of this invention to provide a scroll-type fluid displacement apparatus wherein the angular relationship between both scroll members is easily and precisely established.

It is still another object of this invention to realize the above objects with simple construction and assembly techniques.

A scroll-type fluid displacement apparatus according to this invention includes a housing having a front end plate and a pair of scrolls. One of the scrolls is fixedly disposed relative to the housing and has a circular end plate from which a first wrap extends. The other scroll member is movably disposed for non-rotative orbital movement within the housing and has a circular end plate from which a second wrap extends. The first and second wraps interfit at an angular and radial offset to form a plurality of line contacts to define at least one pair of sealed off fluid pockets. A driving mechanism is operatively connected to the other scroll to effect its orbital motion while rotation of the orbiting scroll is prevented by a rotation preventing/thrust-bearing means, whereby the fluid pockets move and change volume. One scroll is formed with a bore or hole. The end plate portion of the housing is also formed with a hole extending completely through it. The hole and bore are adapted to be aligned with one another by an adjustment member. The adjustment member extends through the holes during the assembly of the apparatus to set the angular relationship between the two scrolls. After aligning the holes and bore, the front end plate is rotated in the driving direction, and then secured in place.

Further objects, features and other aspects of this invention will be understood from the detailed description of the preferred embodiments with reference of the annexed drawings.

DETAILED DESCRIPTION OF PREFERRED EMBODIMENTS

Figure 1:
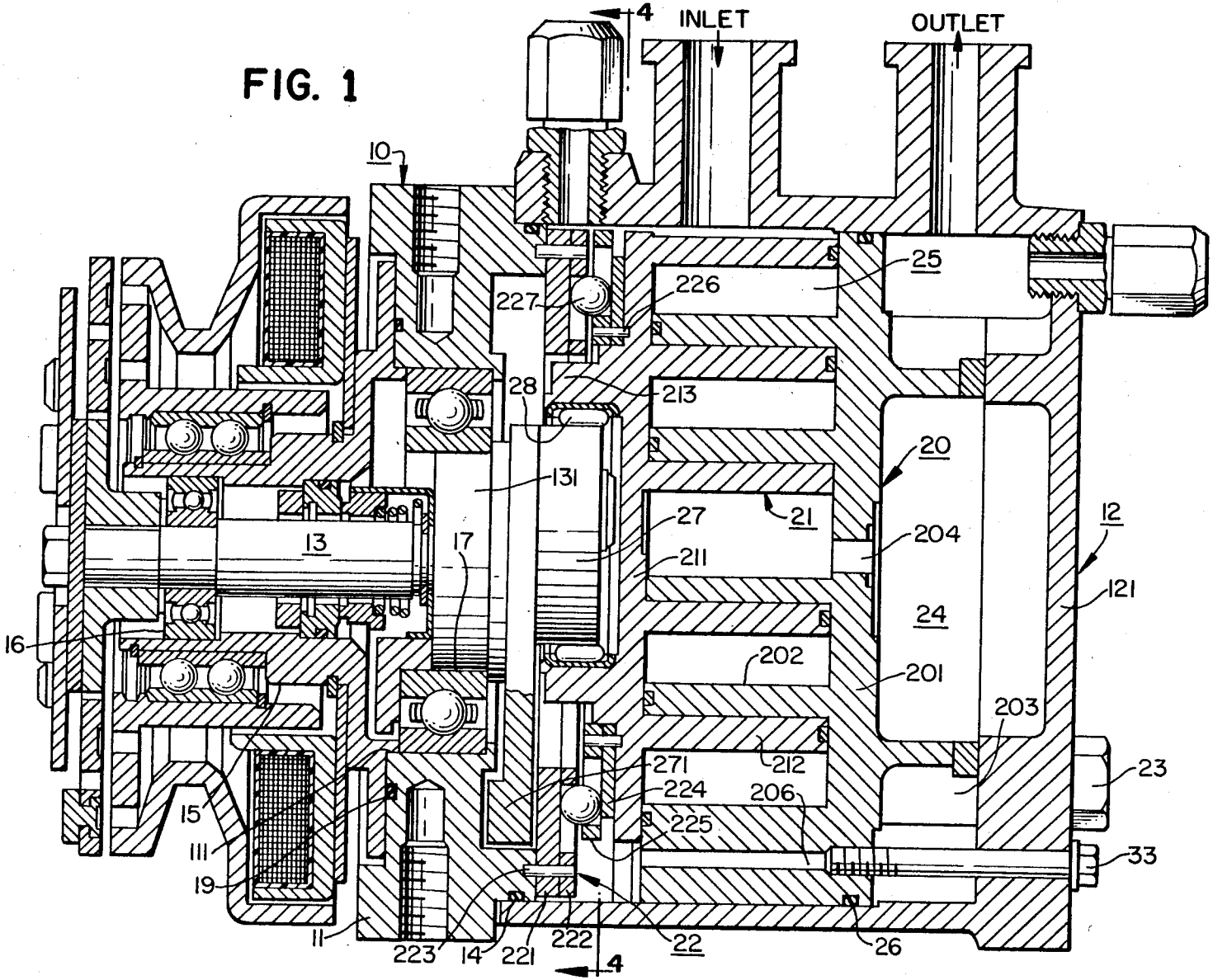
FIG. 1 is a vertical sectional view of a scroll-type compressor according to one embodiment of this invention.

Referring to FIG. 1, an embodiment of a scroll-type fluid displacement apparatus, in particular a scroll-type refrigerant compressor, in accordance with the present invention is shown. The compressor includes a compressor housing 10 having a front end plate 11 and a cup-shaped casing 12 fastened on the rear end surface of front end plate 11. An opening 111 is formed in the center of front end plate 11 for penetration or passage of a drive shaft 13. An opening portion of cup-shaped casing 12 is covered by front end plate 11, and the mating surface between front end plate 11 and cup-shaped casing 12 is sealed by an O-ring 14. Front end plate 11 has an annular sleeve 15 projecting from the front end surface thereof which surrounds drive shaft 13 and defines a shaft seal cavity.

Drive shaft 13 is rotatably supported by sleeve 15 through a bearing 16 located within the front end of sleeve 15. Drive shaft 13 has a disk-shaped rotor 131 at its inner end which is rotatably supported by front end plate 11 through a bearing 17 located within opening 111 of front end plate 11.

A number of elements are disposed within the interior of cup-shaped casing 12, including a fixed scroll 20, an orbiting scroll 21, a driving mechanism for orbiting scroll 21 and a rotation-preventing/thrust-bearing mechanism 22 for orbiting scroll 21. The interior of cup-shaped casing 12 is defined between the inner wall of cup-shaped casing 12 and the rear end surface of front end plate 11.

Fixed scroll 20 includes a circular end plate 201, a wrap or spiral element 202 affixed to or extending from one side surface of circular end plate 201 and a plurality of internally threaded bosses 203 axially projecting from the other side surface of circular end plate 201. An axial end surface of each boss 203 is seated on the inner surface of end plate 121 of cup-shaped casing 12 and is fixed to end plate 121 by bolts 23. Fixed scroll 20 is thus fixed within cup-shaped casing 12. Circular end plate 201 of fixed scroll 20 partitions the inner chamber of cup-shaped casing 12 into two chambers, such as discharge chamber 24 having bosses 203, and a suction chamber 25 in which spiral element 202 is located. A sealing ring 26 is placed between the outer peripheral surface of circular end plate 201 and the inner surface of cup-shaped casing 12 to secure the seal therebetween. A hole or discharge port 204 is formed through circular end plate 201 of fixed scroll 20 at a position near the center of spiral element 202. Hole 204 is connected between the fluid pocket of the spiral elements center and discharge chamber 24.

Orbiting scroll 21, which is disposed in suction chamber 25, comprises a circular end plate 211 and a wrap or spiral element 212 affixed to or extending from one side surface of end plate 211. The spiral element 212 of orbiting scroll 21 and spiral element 202 interfit at an angular offset of 180° and predetermined radial offset to make a plurality of line contacts. Therefore, at least one pair of sealed off fluid pockets are defined between their spiral elements 202 and 212. Orbiting scroll 21 is connected to the driving means and rotation-preventing/thrust-bearing means 22. These last two means effect the orbital motion of orbiting scroll 21 by rotation of drive shaft 13.

Figure 2:
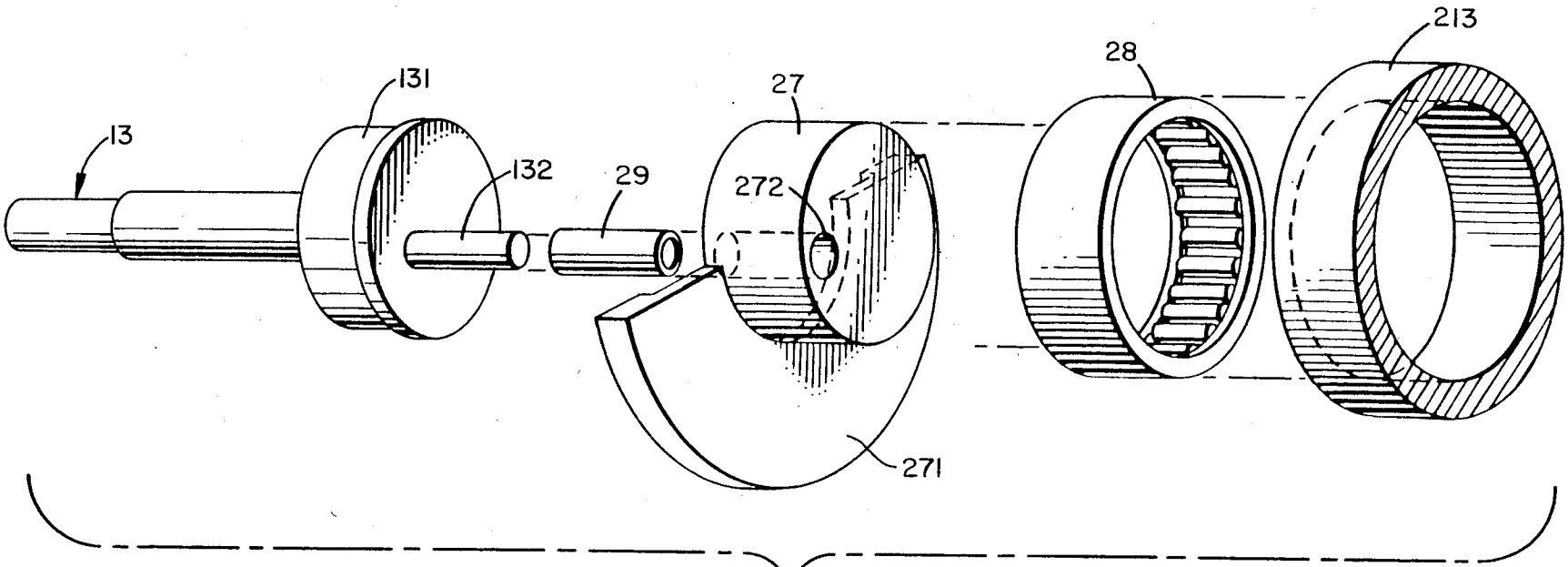
FIG. 2 is an exploded perspective view of a driving mechanism for an orbiting scroll used in the compressor of FIG. 1.

Referring to FIGS. 1 and 2, the driving mechanism of orbiting scroll 21 will be described. Drive shaft 13 is formed with a disk-shaped portion 131 at its inner end and is rotatably supported by sleeve 15 through a bearing 16 which is disposed within sleeve portion 15. Disk-shaped portion 131 is rotatably supported by front end plate 11 through bearing 17.

A crank pin or drive pin 132 projects axially from an end surface of disk-shaped portion 131 and is radially offset from the center of drive shaft 13. Circular plate 211 of orbiting scroll 21 is provided with a tubular boss 213 axially projecting from an end surface opposite to the side thereof from which spiral element 212 extends. A discoid or short axial bushing 27 is fitted into boss 213, and is rotatably supported therein by a bearing, such as a needle bearing 28. Bushing 27 has a balance weight 271 which is shaped as a portion of a disk or ring and extends radially outward from bushing 27 along a front surface thereof. An eccentric hole 272 is formed in bushing 27 radially offset from the center of bushing 27. Drive pin 132 is fitted into the eccentrically disposed hole 272 within which a bearing 29 may be applied. Bushing 27 is therefore driven by the revolution of drive pin 132 and is permitted to rotate by needle bearing 28.

Figure 3:
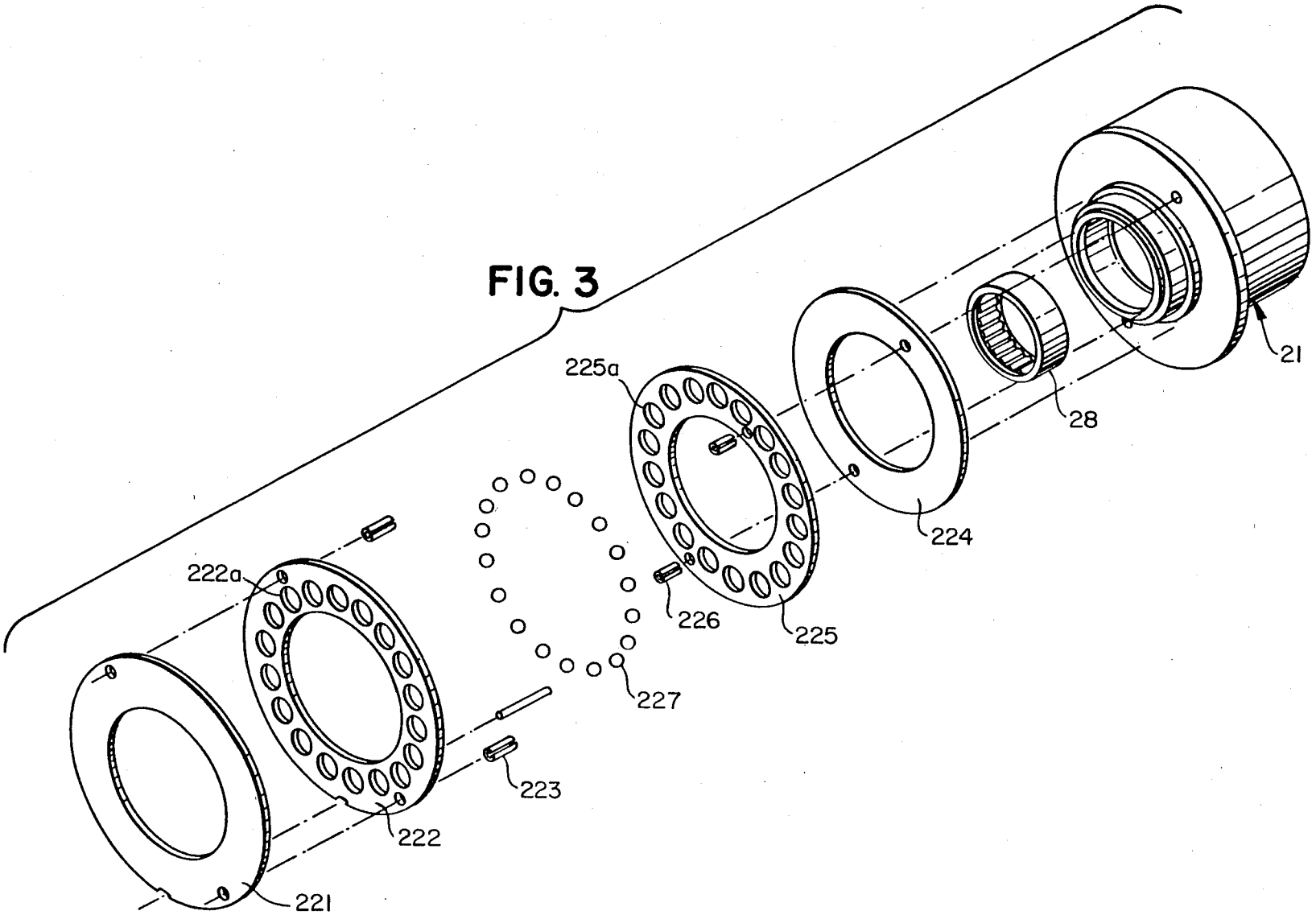
FIG. 3 is an exploded perspective view of a rotation-preventing/thrust-bearing mechanism for an orbiting scroll used in the compressor of FIG. 1.
Figure 4:
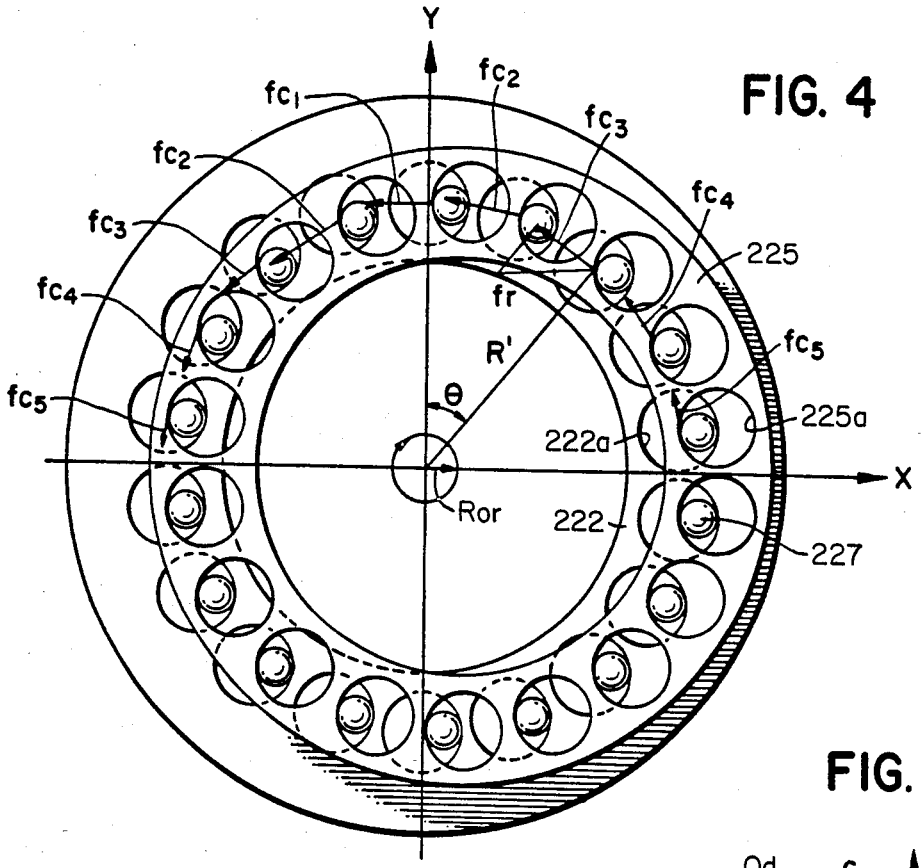
FIG. 4 is a sectional view taken along the line IV—IV of FIG. 1.
Figure 5:
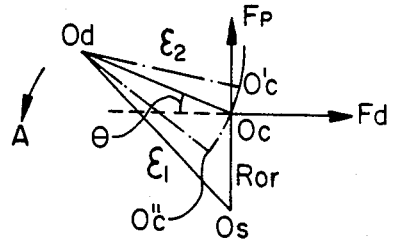
FIG. 5 is a diagram of the motion of the bushing in the embodiment of FIG. 1.

Referring to FIG. 3, the rotation-preventing/thrust-bearing device 22 will be described. Rotation-preventing/thrust-bearing device 22 is disposed between the rear end surface of front end plate 11 and the end surface of circular end plate 211 of orbiting scroll 21 on the side opposite spiral element 212. Rotation-preventing/-trust-bearing device 22 includes a fixed portion, an orbital portion and a bearing element, such as a plurality of spherical balls.

The fixed portion includes an annular fixed race 221 having one end surface fitted against the axial end surface of an annular projection of front end plate 11, and a fixed ring 222 fitted against the other axial end surface of fixed race 221. Fixed race 221 and fixed ring 222 are attached to the axial end surface of the annular projection by pins 223.

The orbital portion also includes an annular orbital race 224, whch has one end surface fitted against an axial end surface of circular end plate 221, and an orbital ring 225 fitted against the other axial end surface of orbital race 224 to extend outwardly therefrom and cover the other axial end surface of orbital race 224. A small clearance is maintained between the end surface of fixed ring 222 and the end surface of orbital ring 225. Orbital race 224 and orbital ring 225 are attached to the end surface of circular end plate 211 by pins 226. Alternatively, rings 222, 225 may be formed integral with races 221, 224, respectively.

Fixed ring 222 and orbital ring 225 each have a plurality of holes or pockets **222*a* and 225*a*, respectively, in the axial direction, the number of holes or pockets in each of rings 222 and 225 being equal. The holes or pockets 222*a* on fixed ring 222 correspond to or are a mirror image of the holes or pockets 225*a* on orbital ring 225; i.e., each pair of pockets facing each other have the same size and pitch, and the radial distance of the pockets from the center of their respective rings 222** and 225 is the same; i.e., the centers of the pockets are located the same distance from the center of rings 222 and 225. Thus, if the centers of rings 222 and 225 were aligned, which they are not in actual operation of the rotation-preventing/thrust-bearing device 22, the holes or pockets 222*a* and 225*a* would be identical or in alignment. Bearing elements, such as balls 227, are placed between facing generally aligned pairs of pockets 222*a* and 225*a* of fixed and orbital rings 222, 225 facing one another at a predetermined clearance.

Figure 6:
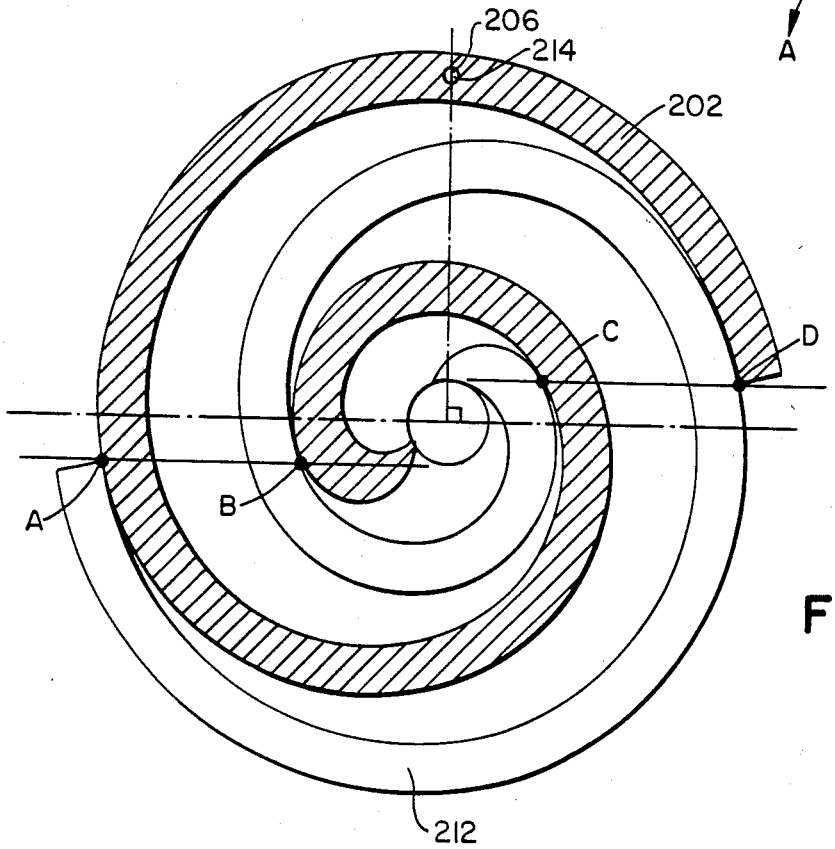
FIG. 6 is a diagrammatic view of a fixed scroll illustrating the position of a hole according to the present invention.

In this construction of a scroll-type compressor, fixed scroll 20 is at least provided with a projection 205 projecting from the outer surface of spiral element 202, and preferably integral with it. A penetrating hole 206 is formed through projection 205 of fixed scroll 20. As shown in FIG. 6, hole 206 is placed on a line which is perpendicular with a line connected through a plurality of line contacts A,B or C,D between spiral elements 202 and 212. Circular end plate 211 of orbiting scroll 21 is also formed with a hole 214. Furthermore, end plate portion 121 of cup-shaped casing 12 is formed with a round hole 122. Hole 122 is designed to be aligned with hole 214 and penetrating hole 206, in a manner described hereinafter. Penetrating hole 206 is provided with a threaded portion 206*a* at one end portion thereof which is adjacent end plate portion 121.

Figure 7:
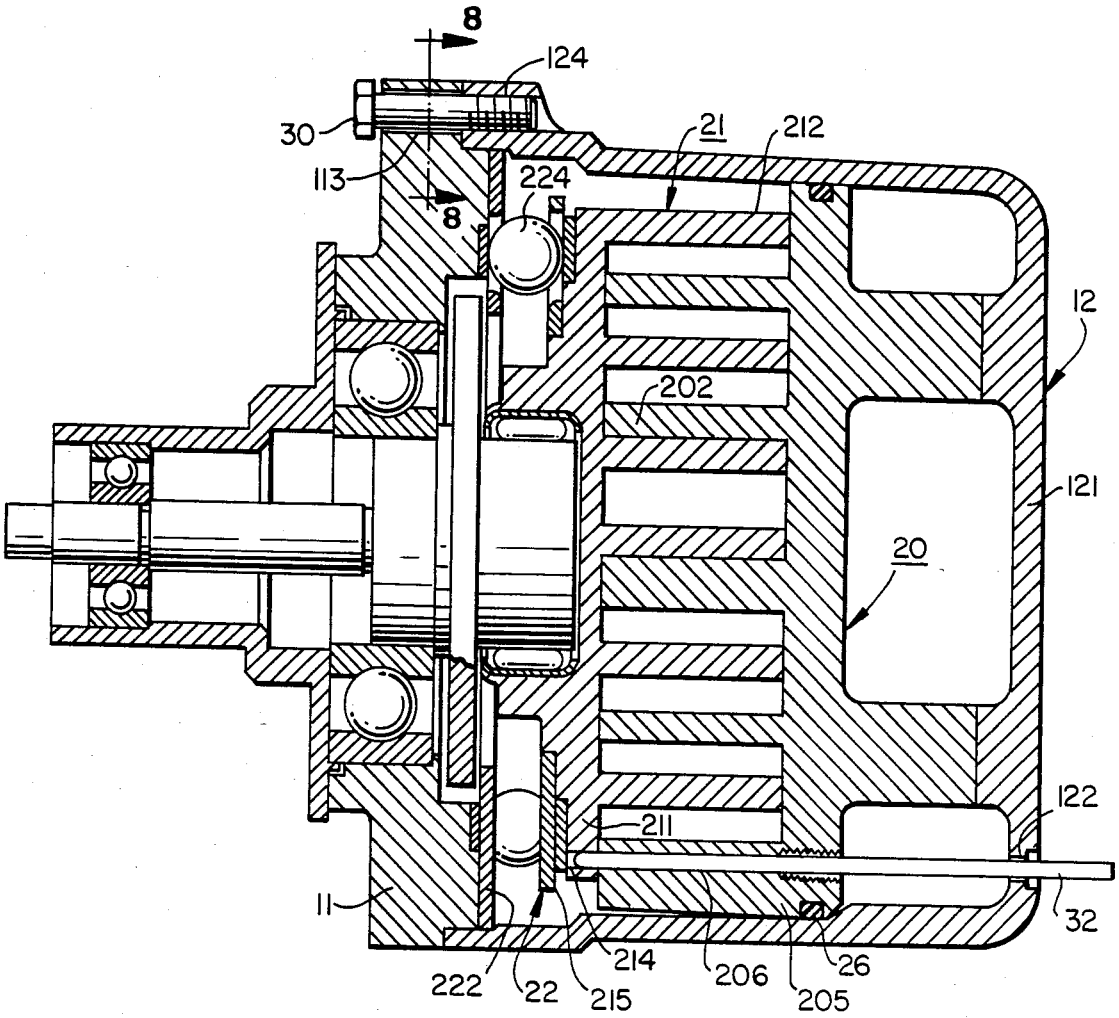
FIG. 7 is a diagrammatic sectional view of the compressor illustrating the operation of the adjusting method of the angular relationship between the spiral elements according to the invention.
Figure 8:
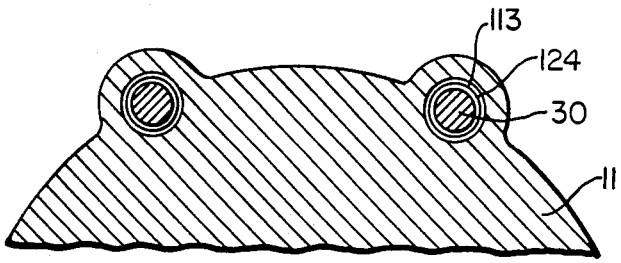
FIG. 8 is a partial sectional view taken along the line VIII—VIII of FIG. 7.

Furthermore, as mentioned above, front end plate 11 fastens to cup-shaped casing 12 by a plurality of bolts 30, one of which is shown in FIG. 7, screwed into threaded portion of hole 124 which is formed in cup-shaped casing 12 through a penetrating hole 113 formed on front end plate 11. As shown in FIG. 8, the diameter of penetrating hole 113 of front end plate 11 is larger than the diameter of threaded hole 124 of cup-shaped casing 12 to permit the relative rotation between front end plate 11 and cup-shaped casing 12.

With the above-described arrangement, assembly of the compressor, and particularly the method of adjusting the relative angular offset of both spiral elements will now be described. After penetrating hole 206 of fixed scroll 20 is aligned with hole 122 of cup-shaped casing 12 by adjusting member 32, fixed scroll 20 is fixed within the interior of cup-shaped casing 12 by a plurality of bolts 23. Then, hole 214 of orbiting scroll 21 which is assembled on front end plate 11 together with the driving mechanism for orbiting scroll 21 and a part of rotation-preventing/thrust-bearing mechanism 22 is aligned with penetrating hole 206 as a result of inserting the end portion of adjusting member 32 through the holes.

After the three holes are aligned with one another by adjusting member 32, front end plate 11 is rotated toward the driving direction of drive shaft 13 to interact with ball 227 between facing pockets 222*a* and 225*a*. This operation is permitted by the difference between the holes formed on front end plate 11 and the cup-shaped casing. After rotating the front end plate 11, bolts 30 are tightly secured to front end plate 11 and cup-shaped casing 12. Since during operation of the apparatus, ball 227 of rotation-preventing/thrust-bearing mechanism 22 usually interact between the edge of both pockets 222*a* and 225*a*, without a gap, to prevent the rotation of orbiting scroll 21, the angular relationship between both scrolls 20 and 21 is thereby determined.

The angular relationship between both scrolls can be adjusted and set by the above-described structure and method. After the predetermined desired offset between the scrolls is aligned and set, adjustment member 32 is removed from the compressor unit. A bolt 33 is screwed into threaded portion 206*a* of penetrating hole 206 through hole 122 of cup-shaped casing 12 to seal off the inner chamber of cup-shaped casing 12.

The invention has been described in detail in connection with a preferred embodiment. However, this embodiment is merely for example only and the invention is not restricted thereto. It will be easily understood by those skilled in the art that other variations and modifications can be easily made within the scope of this invention, as defined by the appended claims.

I claim:

1. In a scroll-type fluid displacement apparatus including a housing having a front end plate and a casing having an end plate portion, assembly means for assembling said front end plate to said casing, a first scroll member having a first end plate from which a first spiral element extends, a second scroll member having a second end plate from which a second spiral element extends, said first and second scroll members interfitting at an angular and radial offset to make a plurality of line contacts to define at least one pair of sealed off fluid pockets, a driving mechanism operatively connected to said second scroll member to effect the orbital motion of said second scroll member, a rotation-preventing/-thrust-bearing mechanism for preventing the rotation of said second scroll member, whereby the fluid pockets, change volume, the improvement comprising said first scroll member having a first hole therethrough, said first hole positioned on a line perpendicular to a line through a plurality of said line contacts, said second end plate of said second scroll member having a bore, said end plate portion of said casing having a second hole therethrough, so that said second hole, said bore, and said first hole may be placed in substantial alignment by an adjusting member inserted into said bore, said first hole and said second hole during assembly of the apparatus, whereby said assembly means allows said front end plate to be rotated in the driving direction of said driving mechanism to set the angular relationship between said scroll members.

2. The scroll-type fluid displacement apparatus of claim 1 wherein said assembly means comprising said front end plate having at least one end plate hole formed therein and said casing having at least one casing hole formed therein opposite said end plate hole, said end plate hole having a diameter greater than the diameter of casing hole so that said front end plate can be rotated.

3. The scroll-type fluid displacement apparatus of claim 2 wherein said front end plate is secured to said casing by a securing device through said end plate hole and said casing hole.

4. The scroll-type fluid displacement apparatus of claim 1 wherein said rotation-preventing/thrust-bearing mechanism comprises a fixed portion and an orbital portion each having a plurality of pockets formed therein, said pockets of said fixed portion facing and generally aligned with said pockets of said orbital portion and a spherical ball bearing element fixed between each of said facing pockets, and wherein said bearing elements interact between edges of said facing pockets when said angular relationship is set.

5. A method for assembling a scroll-type fluid displacement apparatus comprising the steps of:

(a) fixing a casing having at least one opening portion and an end plate portion about a fixed scroll member having a circular end plate from which a first wrap extends;

(b) assembling a driving mechanism and an orbiting scroll member operatively connected to said driving mechanism on a front end plate;

(c) placing said front end plate into said opening portion of said casing and loosely securing said front end plate on said casing with a fastening device so that said fixed scroll member and said orbiting scroll member interfit at an angular and radial offset to make a plurality of line contacts to define at least one pair of sealed off fluid pockets;

(d) inserting an adjusting member through a hole formed in said orbiting scroll member, a hole formed through said fixed scroll member, and a hole formed through said end plate portion of said casing so that said holes are in substantial alignment, said hole formed in said fixed scroll member positioned on a line perpendicular to a line through a plurality of said line contacts;

(e) rotating said front end plate in the driving direction of said driving mechanism until said front end plate is prevented from further movement;

(f) fixing said front end plate to said casing by tightening said fastening device; and (g) closing said hole in said end plate portion of said casing.

* * * * *